United States Patent [19]

Relyea et al.

[11] Patent Number: 4,822,116

[45] Date of Patent: Apr. 18, 1989

[54] BACK-TO-BACK DRAWER ASSEMBLY WITH STAGGERED BYPASSING SLIDES

[75] Inventors: Christopher M. Relyea; Michael S. Relyea, both of Grove City, Ohio

[73] Assignee: Drustar Inc., Grove City, Ohio

[21] Appl. No.: 159,445

[22] Filed: Feb. 18, 1988

Related U.S. Application Data

[63] Continuation of Ser. No. 35,073, Apr. 6, 1987, abandoned.

[51] Int. Cl.[4] ..... A47B 81/00

[52] U.S. Cl. ..... 312/209; 312/250; 312/287; 312/341 NR; 312/350

[58] Field of Search ..... 312/209, 250, 287, 341 NR, 312/350, 333, 351, 289

[56] References Cited

U.S. PATENT DOCUMENTS

| | | | |
|---|---|---|---|
| 2,198,239 | 4/1940 | McK Baird | 312/287 X |
| 2,620,079 | 12/1952 | Rosenbaum | 312/287 X |
| 3,097,901 | 7/1963 | Schless | 312/350 X |
| 3,285,685 | 11/1956 | Hewett | 312/287 |
| 3,929,386 | 12/1975 | Read | 312/341 NR |
| 4,231,626 | 11/1980 | Amtmann et al. | 312/350 |

*Primary Examiner*—Joseph Falk
*Attorney, Agent, or Firm*—Frost & Jacobs

[57] ABSTRACT

A drawer assembly for use in a unit having a transverse opening therethrough with two sets of drawers mounted in the opening in back-to-back relationship, the sets of drawers being openable from opposite sides of the unit. The assembly comprises a pair of identical panels defining the sides of the unit opening. Each panel provides a plurality of horizontal, evenly spaced drawer guides, corresponding guides on the panels having coplanar guide surfaces. The drawers of both sets are identical, except for vertical depth, and are interchangeable within each set and from set-to-set. Each drawer comprises an open rectangular frame having front and rear panels joined by first and second side panels. First and second mirror image drawer slides are affixed to the first and second side panels, respectively. The first slide is located near the upper edge of the first side panel and the second slide is located near the lower edge of the second side panel, the vertical distance between the lower surfaces of the first and second slides being equivalent to the vertical distance between the upper surfaces of two adjacent guides. The slides are of a length slightly less than that of the guides. Each drawer has a bottom element affixed to its frame and determining the vertical drawer depth. The staggered arrangement of the drawer slides enables the slides of the drawers of the two back-to-back sets to engage different guides with the slides of each set by-passing the drawers of the other set.

16 Claims, 12 Drawing Sheets

100
101
20
20
98
19
19
106
18
18
103
102
97
97
58
90
103
102
90
97
97
95
102
103
17
17
97
97
16
16
102
104
103
15
105
99
15

100
101
58b
106
58
90
58a
91
99

101
100
106
102
103
58
103
102
90
92
103
102
104
103
102
105
99

BACK-TO-BACK DRAWER ASSEMBLY WITH STAGGERED BYPASSING SLIDES

This is a continuation of co-pending application Ser. No. 035,073 filed on Apr. 6, 1987, now abandoned.

TECHNICAL FIELD

The invention relates to a drawer assembly for units of the type having a transverse opening therethrough and utilizing two sets of drawers mounted in the opening in back-to-back relationship, and more particularly to such an assembly utilizing rectilinear drawer guides mounted on opposite sides of the transverse opening and drawers having vertically staggered slides such that the slides of back-to-back drawers engage different guides, with the slides of each drawer bypassing the other drawer.

BACKGROUND ART

The teachings of the present invention are applicable to any type of unit having a transverse opening therethrough with two sets of drawers mounted in the opening in back-to-back relationship, the sets of drawers being openable from opposite sides of the unit. This kind of arrangement can be found in certain types of laboratory work stations, parts cabinets, kitchen counters and the like. While not intended to be so limited, for purposes of an exemplary showing, the drawer assembly of the present invention will be described in its application to medicine containing and dispensing carts of the type utilized in hospitals and nursing homes.

Prior art workers have devised numerous types of back-to-back drawer arrangements. Some arrangements involve complex and expensive telescoping drawer slide and guide mechanisms. In the medical cart field, for example, back-to-back drawers are frequently provided with slides occupying the same guides. This limits the amount by which each drawer can be opened and remain stable within the cart. Yet another approach is to provide a series of drawers which extend the full distance from one side of the cart to the other and which are openable from either side of the cart. Such drawers may be provided with a central transverse divider, if desired. A problem in such an arrangement, however, lies in the fact that when one of the drawers is opened from one side of the cart, it exposes the drawer beneath and its contents on the opposite side of the cart.

The present invention is based upon the discovery that the problems enumerated above can be eliminated by providing the drawers of a back-to-back drawer assembly with staggered slides. To this end, the transverse drawer-containing opening of the medical cart or like unit is provided on its opposite sides with a plurality of parallel, horizontal, evenly spaced drawer guides extending substantially the length of the opening. Corresponding drawer guides on each side of the opening provide upper horizontal surfaces which are coplanar.

The cart may be provided with two sets of drawers, openable from opposite sides of the cart and mounted therein in back-to-back relationship. All of the drawers may be identical, some differing from others only in vertical depth. Each drawer is provided with a pair of slides, one slide of the pair being mounted on each drawer side. The slides are so mounted that they are vertically staggered, the vertical distance between the lower horizontal working surfaces of the staggered slides of a drawer being substantially equal to the vertical distance between the upper surfaces of an adjacent pair of drawer guides. The the drawer slides may have a length only slightly less than the length of the drawer guides. As a consequence, when a drawer is fully opened on either side of the cart, substantially half the length of its slides remain in contact with their respective guides, assuring that the drawer is firmly mounted in the cart and fully stable. When a pair of drawers are located back-to-back at the same level in the transverse drawer opening of the cart, all four of their slides (two slides per drawer) will contact four different guides and the slides of each drawer will bypass or slip along-side the other drawer. Furthermore, as will be explained hereinafter, the drawers on each side of the cart may be interchangeable with other drawers on that same side or with drawers on the opposite side of the cart. The drawer arrangement of the present invention is simple in construction and relatively easy and inexpensive to manufacture. The drawers are firmly held and stable when fully opened and easy to manipulate. The opening of one drawer does not expose any other drawer or its contents.

DISCLOSURE OF THE INVENTION

According to the invention there is provided a drawer assembly for use in a cart or unit having a transverse opening therethrough with two sets of drawers slidably mounted within the opening in back-to-back relationship. The sets of drawers are openable from opposite sides of the cart or unit.

The assembly comprises a pair of identical panels defining the sides of the unit opening. Each panel provides a plurality of horizontal, evenly spaced drawer guides extending substantially the length of the opening. Corresponding guides on the panels have coplanar guide surfaces.

All of the drawers of both sets are identical, with the exception that some of the drawers may have greater vertical depth than others. As a result, a given drawer may be inserted into the transverse opening from either side of the unit. Furthermore, the drawers within a set are interchangeable.

Each drawer comprises an open rectangular framework, comprising front and rear panels and first and second side panels. Each drawer is provided with first and second mirror image drawer slides affixed to the first and second side panels, respectively. The first slide is mounted on the first side panel near the upper edge thereof, and the second slide is mounted on the second side panel near the lower edge thereof. As a consequence, there is a vertical distance between the lower surfaces of the first and second slides, this vertical distance being equivalent to the vertical distance between the upper surfaces of two adjacent guides. All of the pairs of mirror image drawer slides of the drawers are identical and have a length only slightly less than the length of the drawer guides. Each drawer has a bottom element affixed to its frame, the configuration of the bottom element determining the vertical depth of the drawer.

The staggered arrangement of the slides on each drawer assures that the slides of the drawers of the two back-to-back sets will always occupy different guides. Furthermore, when the drawers are in their closed positions, the slides of the drawers of each set will bypass or lie along-side the drawers of the other set.

DETAILED DESCRIPTION OF THE INVENTION

Figure 1:
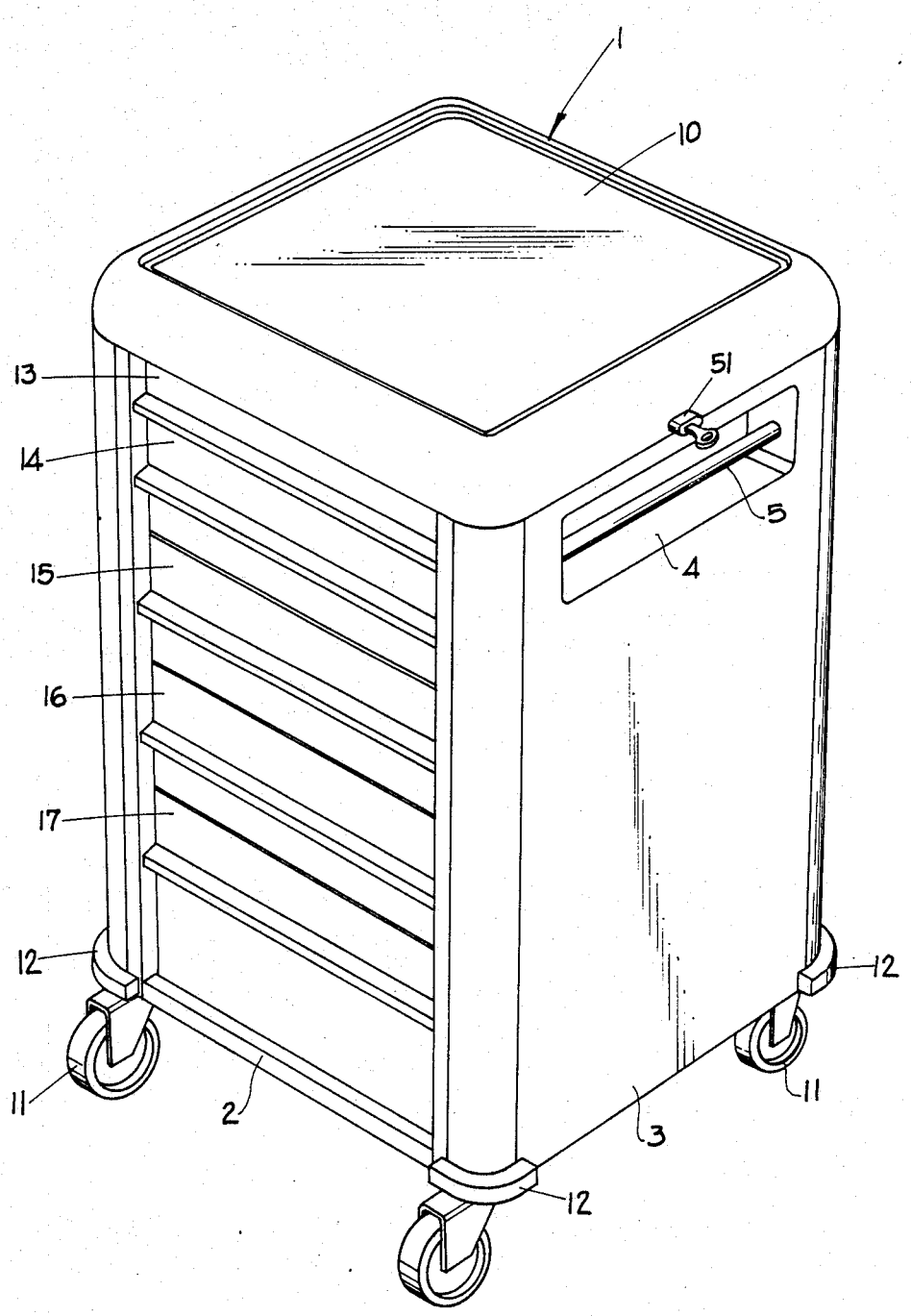
FIG. 1 is a perspective view of an exemplary medicine dispensing cart showing one side and one end thereof.
Figure 2:
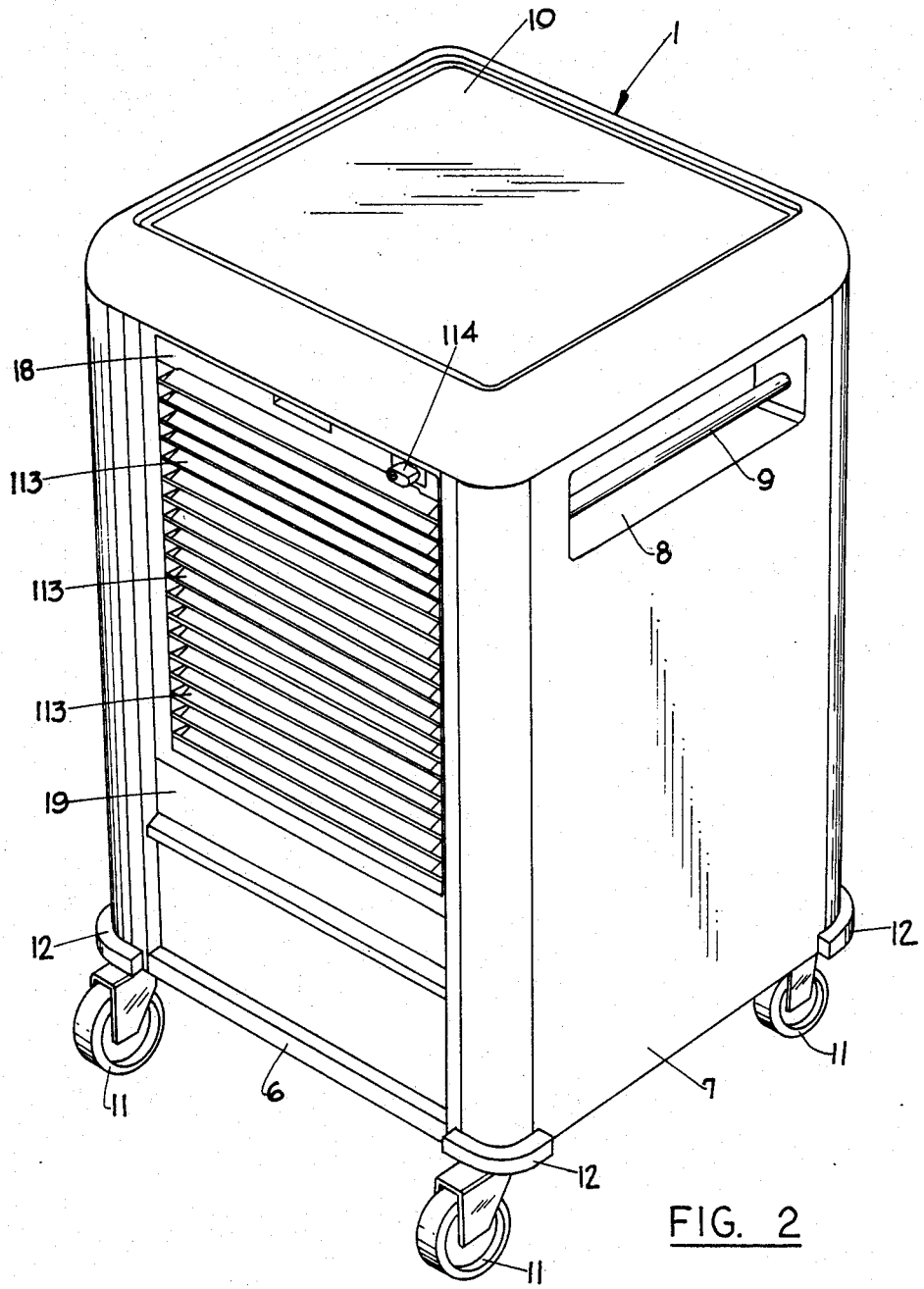
FIG. 2 is a perspective view of the cart of FIG. 1, illustrating the other side and other end thereof.

Reference is first made to FIGS. 1 and 2 wherein a medicine containing and dispensing cart of the type used in hospitals, nursing homes and the like is generally indicated by index numeral 1. In FIG. 1, a first side 2 is shown, together with a first end 3. The end 3 is illustrated as having a transverse rectangular recess 4 therein, housing a handle 5 by which the cart may be guided. In FIG. 2, a second side of the cart is shown at 6, together with the second end 7 which is substantially identical to end 3. Again, end 7 is provided with a transverse recess 8 in which a handle 9 for the cart is located.

The cart 1 is provided with a top 10 and casters 11 at its four corners. The four corners may be protected by resilient bumbers 12.

In FIG. 1, the first side 2 of cart 1 is arbitrarily illustrated as containing five drawers 13 through 17. Again, arbitrarily, the second side 6 of cart 1 is illustrated in FIG. 2 as having a cassette (to be described hereinafter) 18 and one drawer 19 located therein. That these arrangements in FIGS. 1 and 2 are purely exemplary will be evident hereinafter.

Figure 3:
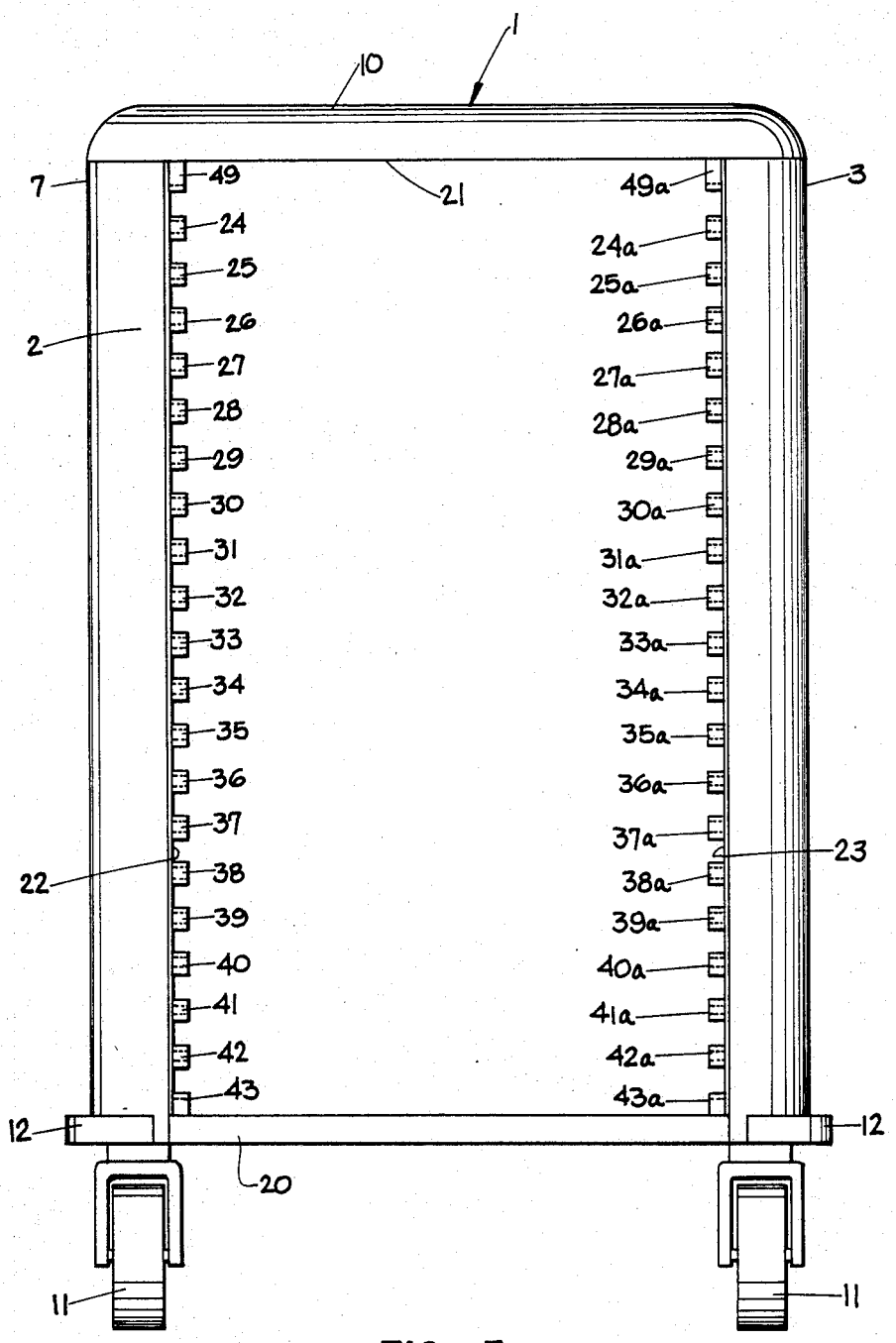
FIG. 3 is a side elevational view of the cart of FIG. 1 with the drawers removed.

Reference is now made to FIG. 3. FIG. 3 is an elevational view of cart 1 as seen from the first side 2 with all of drawers 13 through 17 and 19 and cassette 18 removed. It will be apparent from FIG. 3 that the cart 1 comprises first end 3, second end 7, top 10 and a bottom framework 20. These elements define a transverse opening 21. Neither the aesthetic and functional design nor the construction of cart 1 constitutes a part of or a limitation on the invention. The primary aspect to keep in mind is that the cart 1 constitutes a unit having the transverse opening 21 extending from its first side 2 to its second side 6.

Figure 4:
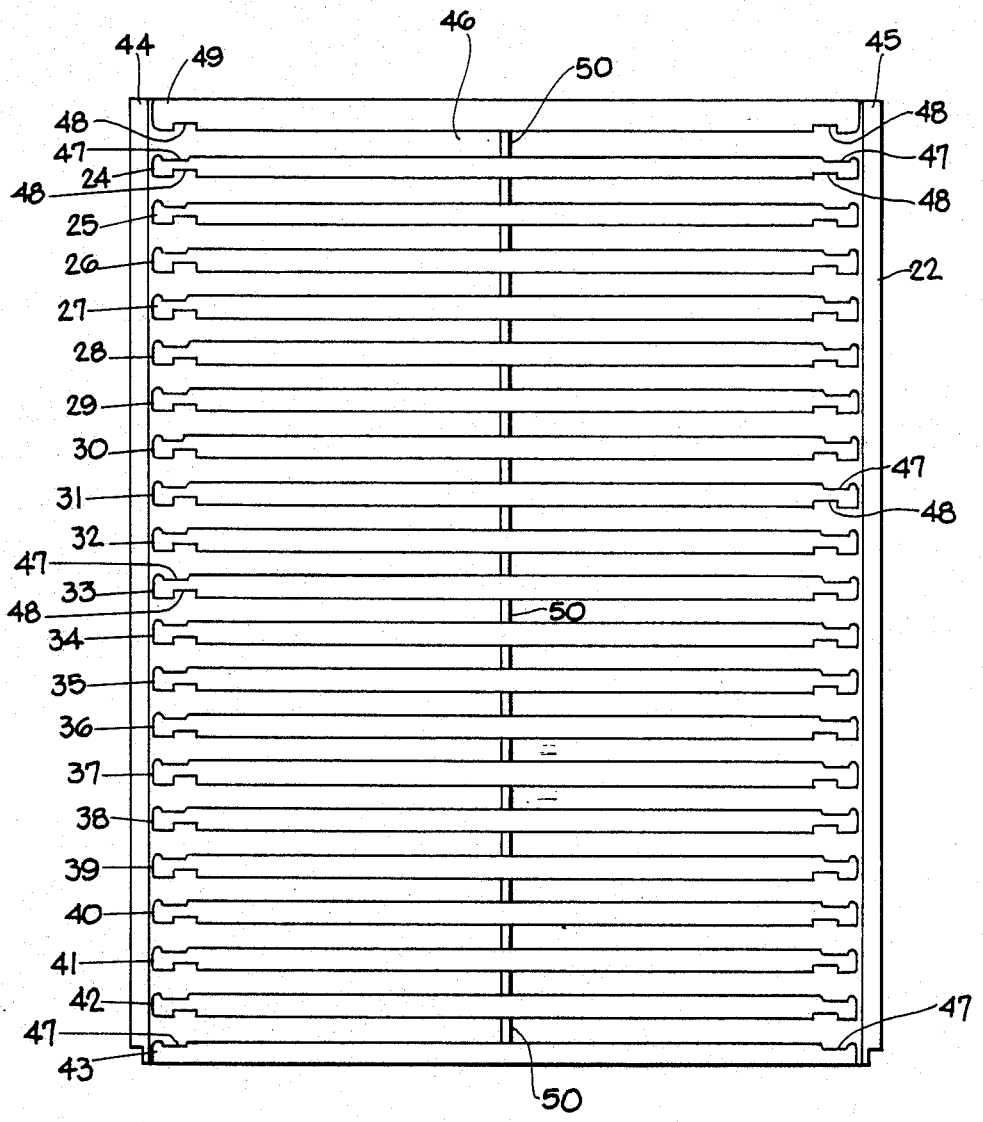
FIG. 4 is an elevational view of a panel insert of the present invention providing a plurality of evenly spaced, horizontal drawer guides.

The sides of opening 21 are defined by a pair of identical panels 22 and 23 affixed to the cart in any appropriate manner. Panel 22 is illustrated in FIG. 4. Since panel 22 is identical to panel 23, a description of panel 22 can serve equally well as a description of panel 23.

In FIG. 4, panel 22 is illustrated as being a molded member of appropriate plastic material having side flanges 44 and 45 by which it is affixed to the cart by suitable fastener means such as screws, rivets or the like. The central body portion 46 of panel 22 is raised slightly out of the plane of flanges 44 and 45. The central body portion 46 has formed thereon a plurality of identical drawer guides 24 through 42. As is apparent from FIG. 3, the drawer guides 24 through 42 extend inwardly of opening 21. These drawer guides are adapted to cooperate with the drawer slides to be described hereinafter.

It will be noted that each of drawer guides 24 through 42 extends substantially the full width of panel 22 (i.e., substantially the full horizontal length of opening 21 from cart side 2 to cart side 6). It will further be noted that the drawer guides are in parallel spaced relationship and evenly spaced along the panel 22. Each drawer guide 24 through 42 has on its upper surface, near its ends, two identical notches 47. Similarly, on its lower surface each drawer guide, near its ends, has an additional pair of notches 48. The purposes of notches 47 and 48 will be apparent hereinafter.

Along its bottom edge, the panel 22 is provided with a lowermost drawer guide 43. Drawer guide 43 is identical to any of drawers guides 24 through 42, with the exception that its lowermost edge terminates with the panel and is not provided with notches 48. In a similar fashion, the upper edge of panel 22 is provided with a drawer guide 49 substantially identical to any of drawer guides 24 through 42. Drawer guide 49, however, differs in that its upper edge terminates with the upper edge of panel 22 and is not provided with notches 47.

Returning to FIG. 3, it will be noted that the corresponding drawer guides on panel 23 have been given the same index numerals as the drawer guides on panel 22, followed by "a". It will further be noted that the upper and lower surfaces of each drawer guide on panel 22 is coplanar with the upper and lower surfaces, respectively, of the corresponding drawer guide on panel 23.

It will be understood that molded panels 22 and 23 with their integral drawer guides represent an expedient mode of manufacture. The teachings of the present invention would apply equally well in an instance where each of the drawer guides constituted separate, individual members affixed to the cart by any appropriate fastening means.

Returning to FIG. 4, the panel 22 is completed by a series of perforations 50 arranged in a vertical row along the vertical center line of the panel and located in body portion 46 between each drawer guide. The perforations 50 permit latch means to extend therethrough to lock both sets of drawers in place, when desired. The latch means are not shown and do not constitute a part of the present invention. They are actuated by the key operated latch member 51 shown in FIG. 1.

Figure 5A:
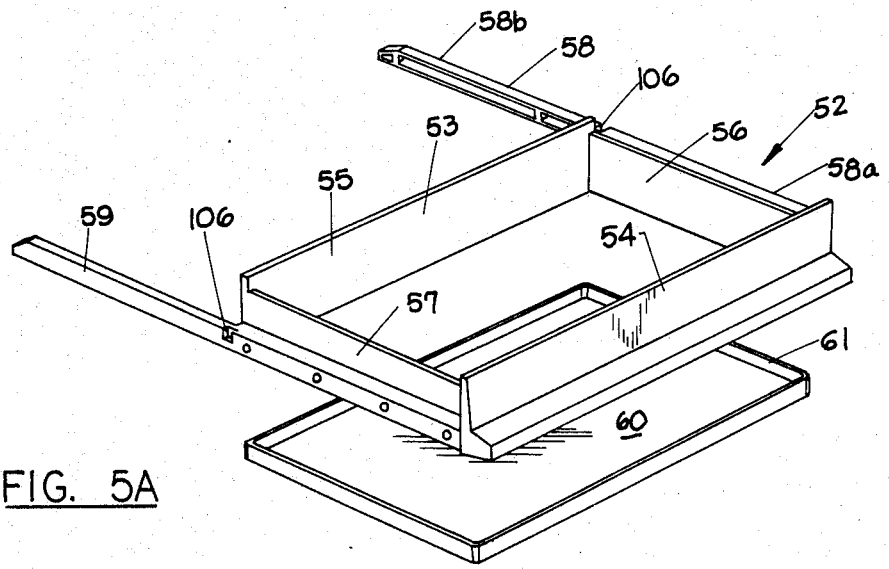
FIG. 5A is an exploded perspective view of a drawer, showing the frame with its slides and an exemplary bottom element.

Reference is now made to FIG. 5A. In this figure, an exemplary drawer is generally indicated at 52. Drawer 52 comprises an open, rectangular drawer frame 53. The drawer frame comprises a front panel 54, a rear panel 55, a first side panel 56 and a second side panel 57. While not a limitation of the present invention, the frame 53 lends itself well to being molded of appropriate plastic material as a single, integral, one-piece structure.

To the first side panel 56 there is affixed a first drawer slide 58. Similarly, a second drawer slide 59 is affixed to second side panel 57. It will be noted that drawer slides 58 and 59 extend rearwardly of frame 53. The drawer 52 is completed by a bottom element 60 which is provided with a peripheral, continuous, upstanding wall 61. The bottom element 60 is affixed to frame 53 by glueing, sonic welding, or the like.

Figure 5B:
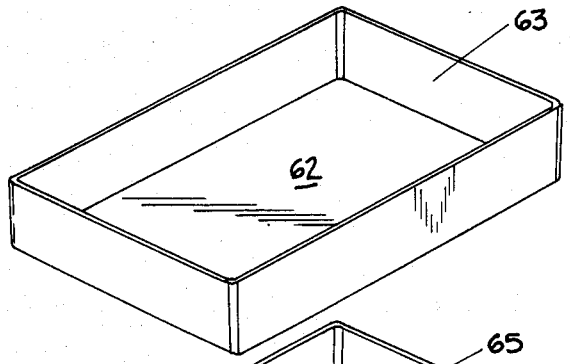
FIGS. 5B and 5C are perspective views of alternative bottom elements.
Figure 5C:
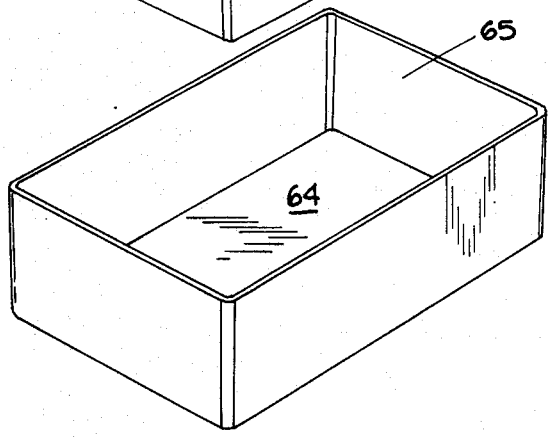

It is important to understand that all of the drawers of the cart of FIGS. 1 and 2 can be made up of rectangular frames identical to frame 53, provided with drawer slides identical to slides 58 and 59. If it is desired to make a drawer of somewhat greater vertical depth, a bottom element such as bottom element 62 of FIG. 5B can be used. The bottom element 62 is provided with a taller continuous, peripheral wall 63. In similar fashion, if it is desired to make up a drawer of even greater vertical depth, the bottom element 64 of FIG. 5C can be used. Bottom element 64 is provided with a continuous, peripheral wall 65 of even greater height that wall 63 of bottom element 62. Except for their vertical dimensions, bottom elements 62 and 64 may otherwise be similar to bottom elements 60 and affixed to frame 53 in the same manner.

By way of example, the opening 21 in cart 1 (see FIG. 3) can have a vertical height of about 30 inches. Utilizing the structure illustrated in FIGS. 5A through 5C, drawers can be made up having vertical dimensions of 3, 6, and 9 inches. In FIGS. 1 and 2, drawer 13 is shown as having a vertical dimenion of 3 inches. Drawers 14, 15 and 16 are shown as having a vertical dimension of 6 inches, while drawers 17 and 19 are illustrated as having vertical dimensions of 9 inches. As will be even more apparent hereinafter, each set of drawers on each side of the cart or unit 1 can comprise any combination of 3, 6, and 9 inch drawers so long as their total height equals 30 inches. Furthermore, the order in which the drawers 13 through 17 of FIG. 1 are inserted into cart 1 can also be changed.

Reference is now made to FIGS. 6 through 11 wherein the frame 53 of FIG. 5A is shown in detail. As indicated above, while not a limitation of the present invention, the frame lends itself well to be molded of plastic material as a single, integral, one-part piece. Frame 53 is so illustrated in FIGS. 6 through 11.

Figure 6:
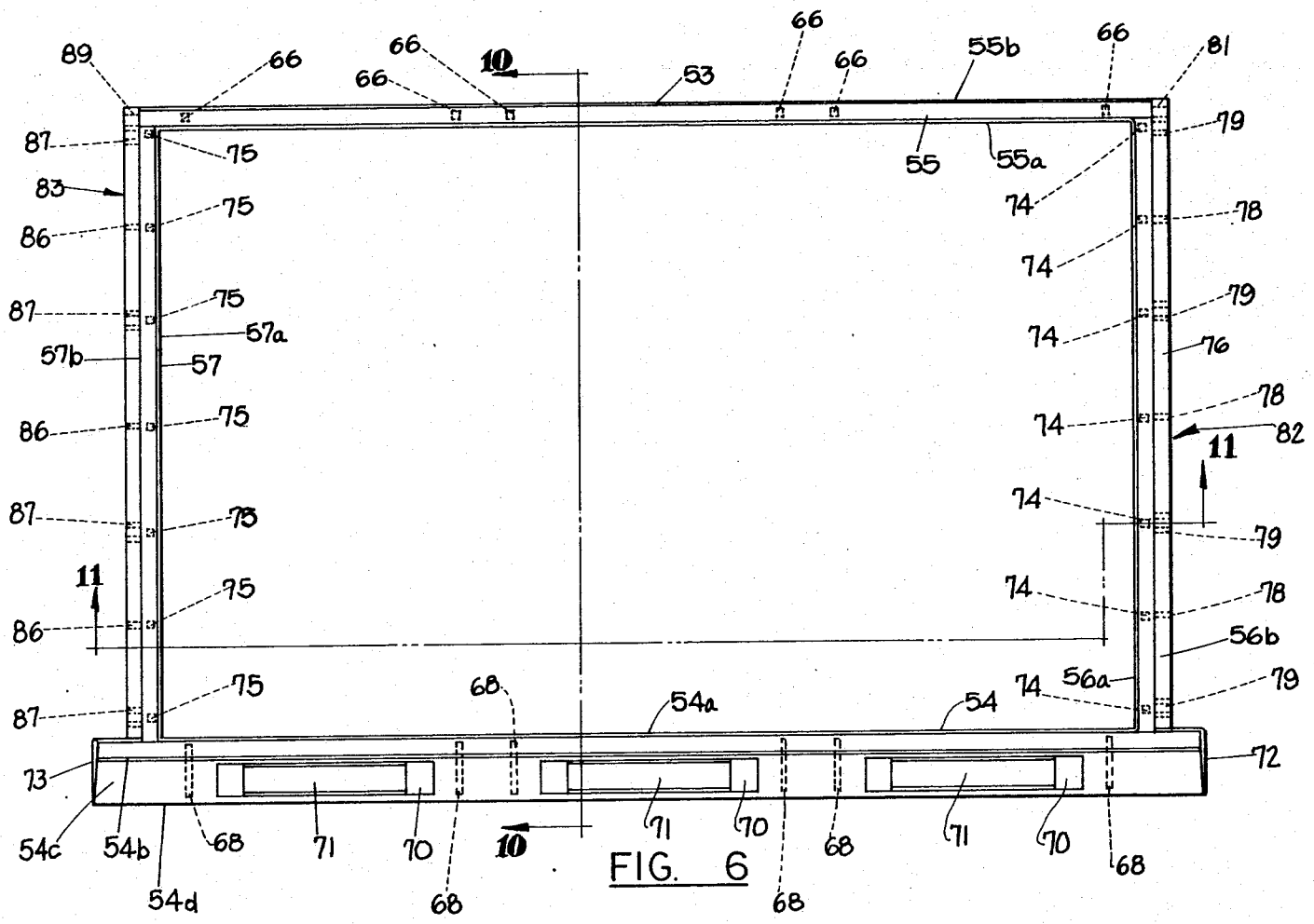
FIG. 6 is a plan view of the drawer frame of the present invention.
Figure 7:
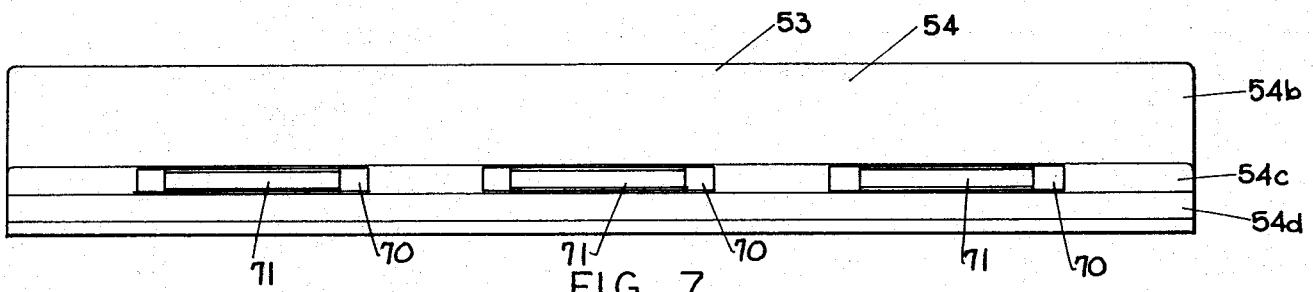
FIG. 7 is a front view of the drawer frame of FIG. 6.
Figure 10:
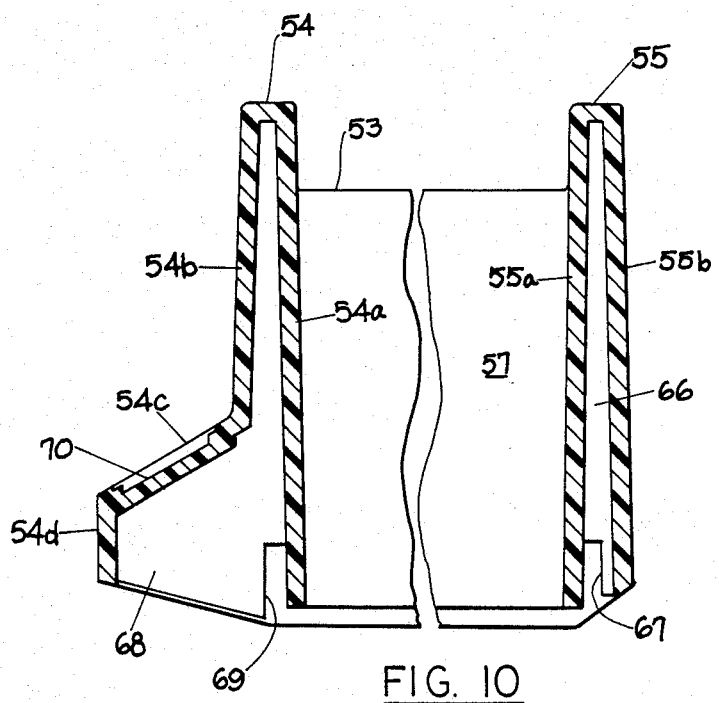
FIG. 10 is a fragmentary cross-sectional view taken along section line 10—10 of FIG. 6.

Turning first to FIGS. 6 and 10, rear panel 55 is made up of an inner wall **55*a* and an outer wall 55*b* joined at their upper edges. Inner and outer walls 55*a* and 55*b* are additionally joined by interior webs 66. As is most clearly shown in FIG. 10, each web 66 has a notch 67 formed therein to receive the upper edge of the peripheral wall of one of the bottom elements 60, 62 or 64**.

The front panel 54 also comprises an inner wall **54*a* and an outer wall 54*b* joined at their upper edges. Outer wall 54*b* is followed by an outwardly and downwardly sloping wall portion 54*c* which, in turn, is followed by a substantially vertical portion 54*d*. Outer wall portions 54*b*, 54*c*, and 54*d* are connected to inner wall 54*a* by a plurality of interior webs 68. Again, the webs 68 are provided with notches 69 adapted to receive the upper edge of the peripheral wall of one of bottom elements 60, 62 and 64**.

The front panel outer wall portion **54*c* may be provided with a series of depressions 70. The depressions 70 are intended to accommodate labels or other indicia, shown in FIGS. 6 and 7 at 71**.

Figure 8:
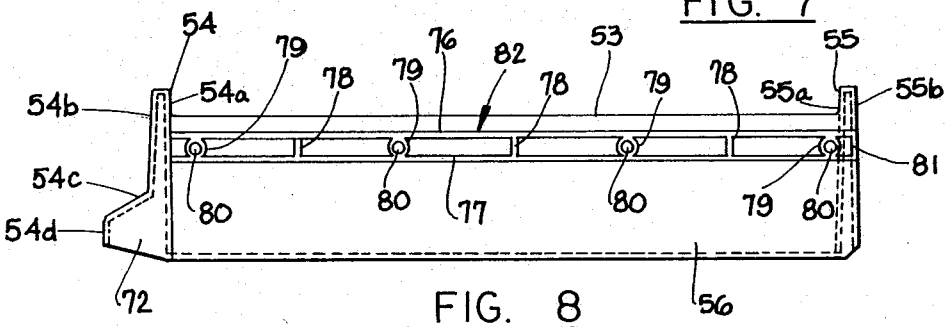
FIG. 8 is a side elevational view of the drawer frame of FIG. 7 as seen from the right of that figure.
Figure 9:
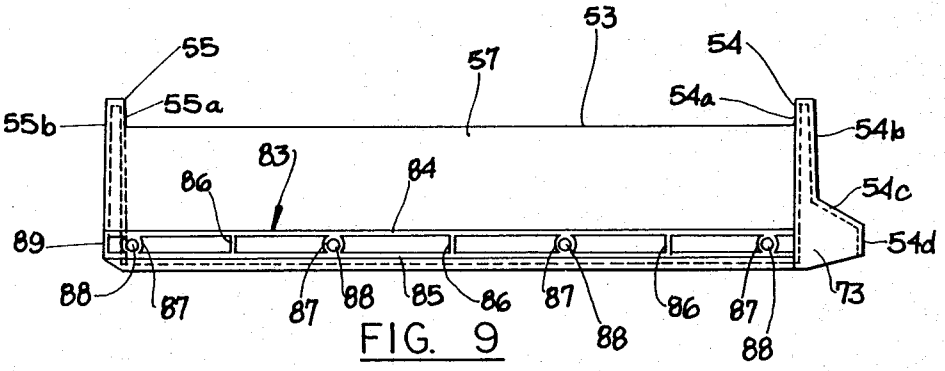
FIG. 9 is a side elevational view of the drawer frame of FIG. 7 as seen from the left of FIG. 6.

It will be noted that the ends of front panel 54 are enclosed as at 72 and 73 (see FIGS. 6, 8 and 9). Since the front panel is hollow, except for webs 68, the wall portions **54*c* and 54*d* thereof, define a drawer pull for drawer 53, extending the full length of front panel 54**.

Figure 11:
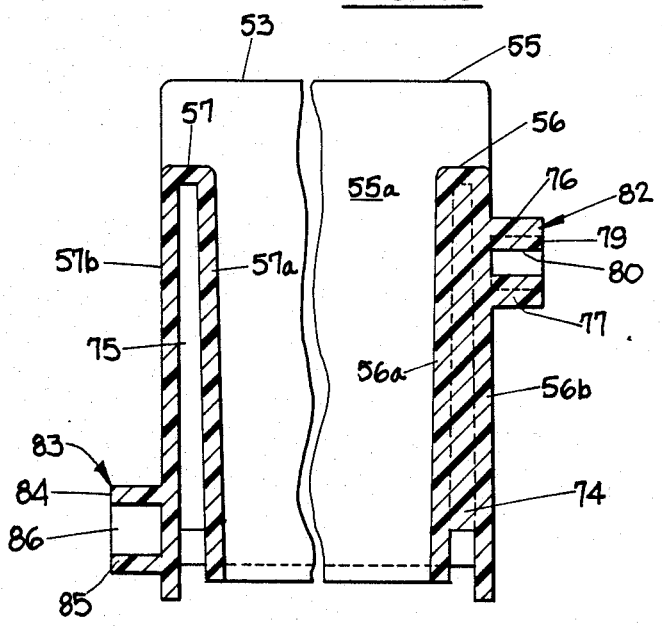
FIG. 11 is a fragmentary cross-sectional view taken along section line 11—11 of FIG. 6.

Reference is now made to FIGS. 6 and 11. It will be noted from FIG. 11 that first side panel 56 comprises an inner wall **56*a* and an outer wall 56*b* joined at their upper edges. At spaced positions between inner and outer walls 56*a* and 56*b* there are reinforcing webs 74. The bottom edges of webs 74 are so positioned as to serve as stops for the peripheral wall of a bottom element 60, 62 or 64**.

In similar fashion, second side panel 57 comprises an inner wall **57*a* and an outer wall 57*b* joined together at the panel top. Again, a plurality of reinforcing webs 75 are located between inner and outer walls 57*a* and 57*b*. As is the case of webs 74 of first side panel 56, the webs 75 have bottom edges serving as stops for the peripheral wall of a bottom element 60, 62 or 64**.

Reference is now made to FIGS. 6, 8 and 11. It will be noted from these figures that first side panel 56 has a pair of laterally extending flanges 76 and 77 arranged in parallel spaced relationship. The flanges 76 and 77 are located near the upper edge of first side panel 56 and extend the length thereof. Reinforcing webs extend between the flanges 76 and 77 as at 78. In addition, evenly spaced along flanges 76 and 77 and extending therebetween, there are cylindrical bosses 79 having central bores 80. The forward ends of flanges 76 and 77 are closed by front panel 54. The rearward ends of flanges 76 and 77 are closed by a web 81 therebetween. This lateral structure just described is generally indicated by index numeral 82 and constitutes a mounting means for the drawer slide, as will be apparent hereinafter.

Reference is now made to FIGS. 6, 9 and 11. It will be noted from these figures that second side panel 57 is provided with a similar slide mount, generally indicated at 83. The slide mount 83 is of the same general construction as slide mount 82 and comprises upper and lower laterally extending flanges 84 and 85 having reinforcing webs 86 located therebetween and cylindrical bosses 87 with central perforations 88. Again, the forward end of slide mount 83 is closed by front panel 54.

The rearward end of slide mount 83 is closed by a web 89.

It will be noted that the slide mount 83 extends the length of second side panel 57. Of primary importance, however, is the fact that the slide mount 83 is located near the bottom edge of second panel 57. This is the primary difference between slide mount 83 and slide mount 82 which is located near the upper edge of the first side panel 56. The reason for the staggering of slide mounts 82 and 83 will be apparent hereinafter. It will be understood that slide mount 82 and slide mount 83 preferably constitute integral, one-piece parts of drawer frame 53.

Reference is now made to FIGS. 12 through 18. In these figures, drawer slide 58 (see FIG. 5A) is illustrated. It will be understood that drawer slide 59 is a mirror image of drawer slide 58 and is otherwise identical thereto. Therefore, a description of drawer slide 58 will suffice as a description of drawer slide 59, as well.

Drawer slide 58 comprises an elongated plastic member of channel-shaped cross-section having a metallic member 90 of channel-shaped cross-section embedded therein for added strength and shape retention. The channel-shaped slide 58 has a top portion 91, a side portion 92, and a bottom portion 93. Similarly, the metallic insert 90 has a top portion 94, a side portion 95, and a bottom portion portion 96. This is clearly shown, for example, in the cross-sectional view of FIG. 17. It will also be noted that the free ends of the plastic top portion 91 and the plastic bottom portion 93 extend about the free ends of the top portion 94 and the bottom portion 96, respectively, of the metallic member 90.

To further lock the metallic channel member 90 within the plastic body of slide 58, at diametrically opposed positions, substantially equally spaced along its length, the metallic member 90 has ports formed therein through which a portion of the plastic of the plastic body of slide 58 extends. This is shown at 97 in FIGS. 13 and 16.

Figures 12, 13, 14:
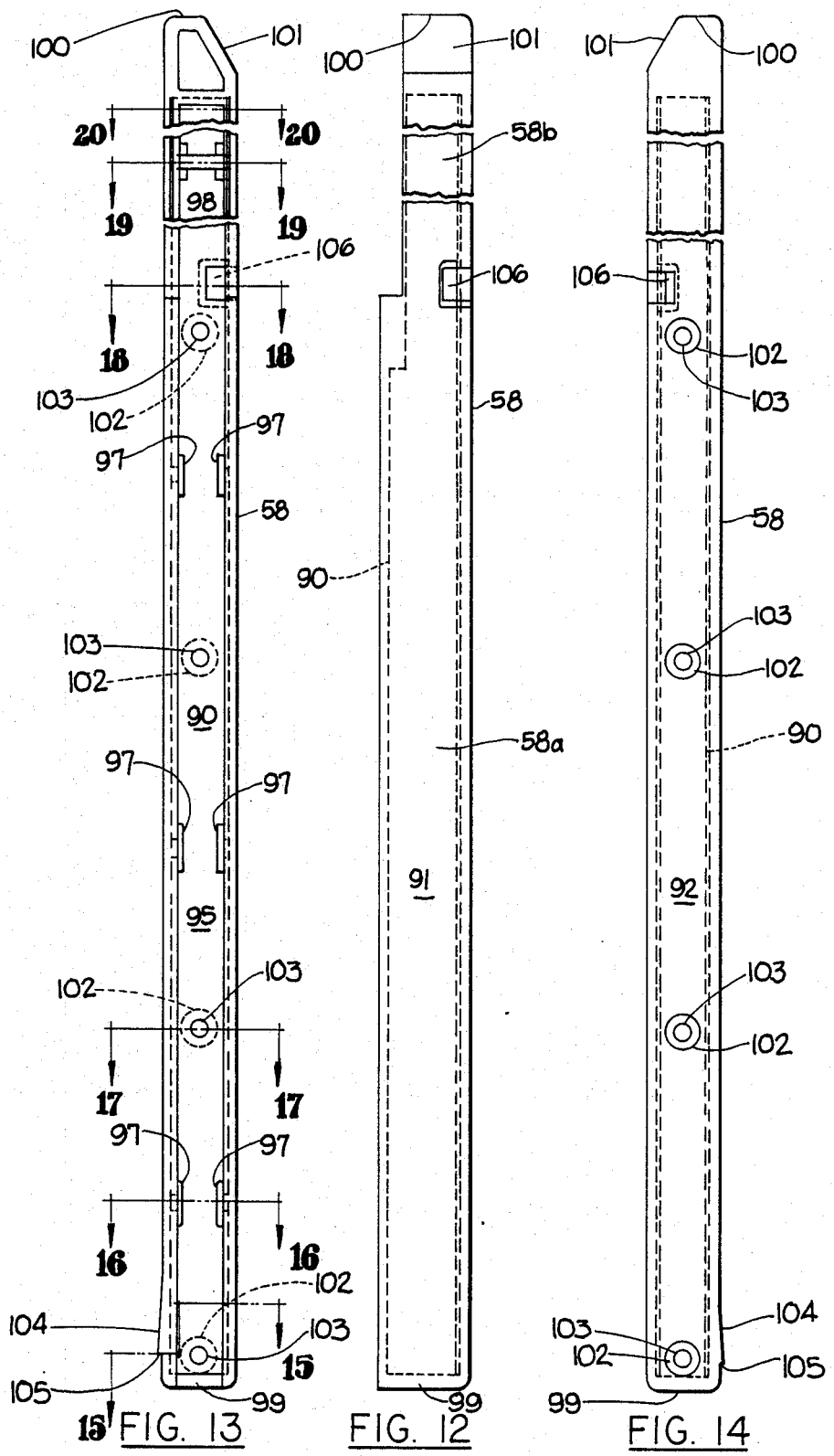
FIG. 12 is a fragmentary plan view of a drawer slide of the present invention.
FIG. 13 is a fragmentary side elevational view of the slide of FIG. 12, as seen from the left of FIG. 12.
FIG. 14 is a fragmentary side elevational view of the slide of FIG. 12, as viewed from the right of FIG. 12.
Figure 15:
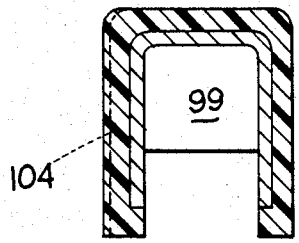
FIG. 15 is a cross-sectional view taken along section line 15—15 of FIG. 13.
Figure 16:
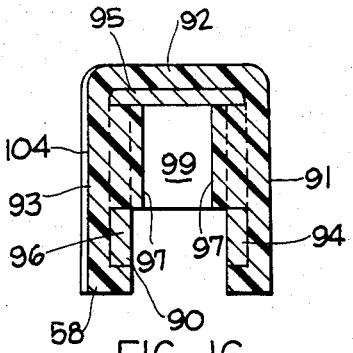
FIG. 16 is a cross-sectional view taken along section line 16—16 of FIG. 13.
Figure 19:
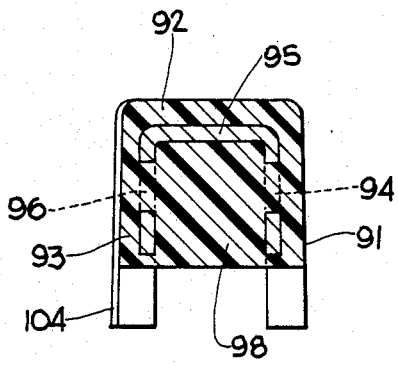
FIG. 19 is a cross-sectional view taken along section line 19—19 of FIG. 13.

As is most clearly shown in FIG. 12, the slide 58 has a first portion **58*a* adapted to lie along its respective drawer frame and to receive mounting means 82. That portion of slide 58 which extends beyond the rear panel 55 of the drawer frame 53 is indicated at 58*b* and is narrower than the portion 58*a* (see also FIG. 5A). The fact that portion 58*b* is narrower than portion 58*a* assures that the portion 58*b* can by-pass with ample clearance an adjacent drawer in back-to-back position. In the portion 58*b* of slide 58, the top portion 94 and the bottom portion 96 of the metallic channel member have perforations formed therein. At this point, a reinforcing web of the plastic material extends across the slide from the plastic top portion 91 to the plastic bottom portion 93. This is shown in FIGS. 13 and 19 at 98**.

The forward end of slide 58 is closed by plastic web 99. The rearward end 100 is also closed and has a tapered surface 101 to facilitate engagement of the slide in the guides.

Figure 17:
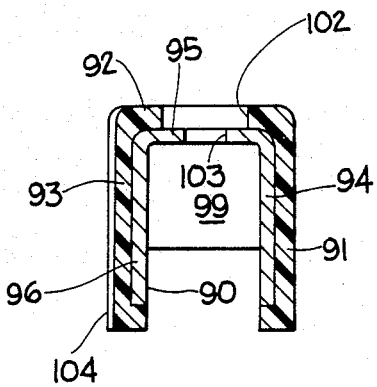
FIG. 17 is a cross-sectional view taken along section line 17—17 of FIG. 13.
Figure 18:
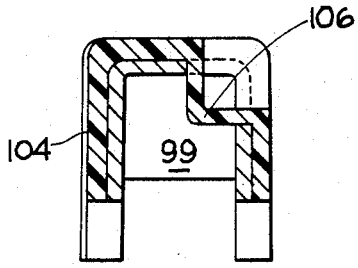
FIG. 18 is a cross-sectional view taken along section line 18—18 of FIG. 13.

With reference to FIGS. 13, 14, and 17, it will be noted that the portion **58*a* of slide 58 is provided with a series of perforations 102 in the plastic side wall 92 and perforations 103 in the side wall 95 of the metallic channel member 90. When the portion 58*a* of slide 58 is placed over the slide mount 82 of frame first side panel 53, the perforations 102 and 103 align with the perforations 80 in mounting means bosses 79. In this way, the slide 58 can be affixed to drawer frame 53 with self tapping machine screws or the like. The holes 102 in the plastic side portion 92 of slide 58** assure that the machine screw heads will be flush with the exterior surface of the slide.

The bottom portion 93 of slide 58 has, near its forward end, a portion which slopes downwardly and forwardly, as at 104, and terminates in a shoulder 105. This is most clearly shown in FIGS. 13 and 14. The shoulder 105 is adapted to cooperate with the upper notches 47 of the drawer guides to maintain the drawers in their closed positions as the cart 1 is wheeled from place to place. The shoulder 105 is very small and does not interfere with purposeful opening of the drawer.

Finally, the slide 58 is completed by a notch 106 formed at the juncture of the top portion 91 and the side portion 92 of slide 58. The notch is made possible by an opening formed in the metal channel member 90, as is clear from the cross-sectional view of FIG. 18. It will be noted from FIGS. 12, 13 and 14 that the notch 106 is located substantially at the juncture of slide portions **58*a* and 58*b*. This places notch 106 just behind the rear panel 55 of drawer frame 53, when the slide 58 is mounted thereon. This is illustrated in FIG. 5A wherein the notch 106 is shown for both slide 58 and slide 59. When the drawer is in its fully closed position in cart 1, the notch 106 will lie opposite one of the openings 50 in panel 22 or panel 23** to be engaged by the locking mechanism, when it is desired to lock the drawer in its closed position.

As indicated above, drawer slide 59 is identical to drawer slide 58, except for being a mirror image thereof. Drawer slide 59 is located over and affixed to slide mount 83 on second side panel 57 in the same manner described with respect to slide 58.

Figure 20:
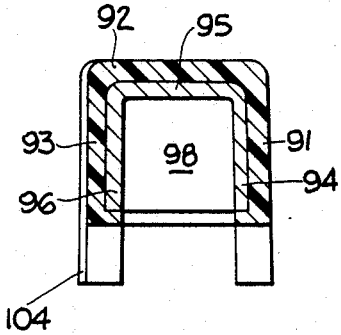
FIG. 20 is a cross-sectional view taken along section line 20—20 of FIG. 13.
Figure 21:
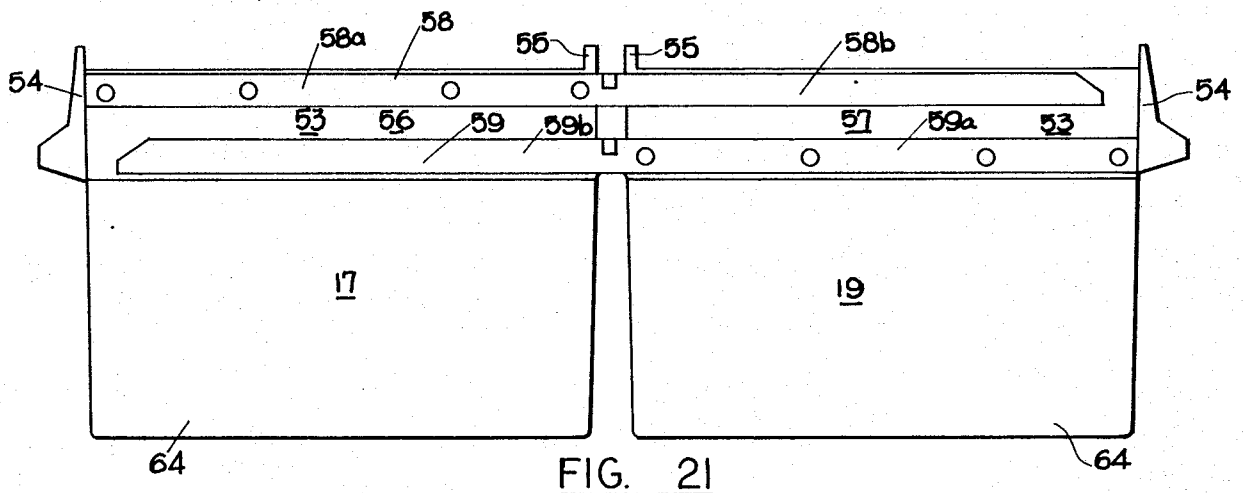
FIGS. 21 and 22 are simplified side elevational views of a pair of drawers of back-to-back relationship.
Figure 22:
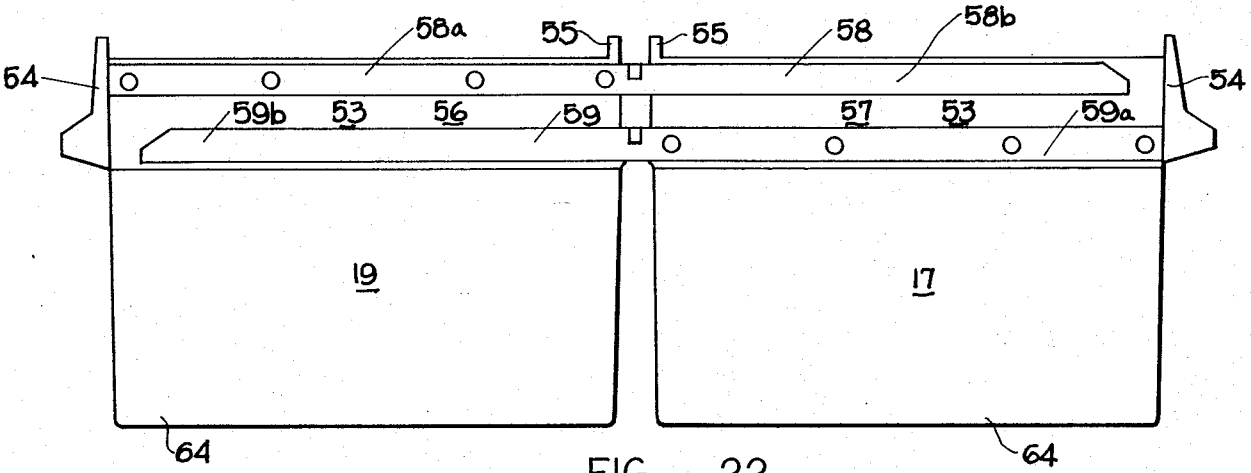

The drawer assembly of the present invention having been described in detail, its operation can be set forth as follows. For purposes of an explanation, reference is made to FIGS. 1, 2, 3, 21 and 22. It will be noted that the bottommost drawer 17 in FIG. 1 has been arbitrarily shown to be a 9-inch drawer. Similarly, the bottommost drawer 19 in FIG. 2 has been shown to be an identical 9-inch drawer, drawers 17 and 19 being in back-to-back relationship. FIGS. 20 and 21 are simplified representations of drawers 17 and 19 in their fully closed positions, with the remainder of the cart having been removed for purposes of clarity. FIG. 21 shows drawers 17 and 19 as they would be seen from the first end 3 of cart 1. FIG. 22 shows the drawers 17 and 19 as the they would be seen from the second end 7 of the cart.

It will be remembered that 9-inch drawers 17 and 19 are identical, each having a frame 53 comprising a front panel 54, a rear panel 55, a first side panel 56, and a second side panel 57. The frame 53 has affixed thereto a bottom element 64. Each of the drawers 17 and 19 has a first or upper slide 58 mounted to its first panel 56 and a second or lower slide 59 mounted to its second side panel 57.

Comparing FIGS. 3, 21, and 22, when the drawers 17 and 19 are in their fully closed positions, the upper slide 58 of drawer 17 will rest upon guide **38*a* of panel 23 and the lower slide 59 of drawer 17 will rest upon guide 39 of panel 22. In similar fashion, the upper slide 58 of drawer 19 will rest upon guide 38 of panel 22, while the lower slide 59 of drawer 19 will occupy guide 39*a* of panel 23. Thus, although the drawers are identical and are located at the same level in the cart, the two slides 58 and 59 of the two drawers 17 and 19 occupy four different guides 38*a*, 39, 38, and 39*a*. As is evident from FIGS. 21 and 22, the narrower portions 58*b* and 59*b* of slides 58 and 59 of drawer 17 by-pass and lie alongside drawer 19. Similarly, the narrower portions 58*b* and 59*b* of drawer slides 58 and 59 of drawer 19 by-pass and lie alongside drawer 17. Thus, neither drawer interferes in any way with the other and is totally independent of the other. It will be apparent to one skilled in the art that the same situation would exist if 9-inch drawer 19 were replaced by one 6-inch drawer and one 3-inch drawer, or three 3-inch drawers. Similarly, the same situation would exist if drawer 17 were replaced by one 6-inch drawer and one 3-inch drawer, or three 3-inch drawers. If both drawers 17 and 19 were replaced by three 3-inch drawers each, or one 6-inch drawer and one 3-inch drawer each, the same situation would exist. As a consequence, first side 2 of cart 1 and second side 6 of cart 1 can each contain any arrangement of drawers so long as their total vertical dimension is equivalent to the total vertical dimension of opening 21. Since the order in which drawers 13 through 17 are placed within opening 22 on the first side 2 of the cart does not make any difference, the drawers of each set are obviously interchangeable within that set. Since all the 3-inch drawers are identical, and all the 6-inch drawers are identical, and all the 9-inch drawers are identical, they are also interchangeable between sets so long as the vertical height of all of the drawers of each set is equivalent to the vertical dimension of opening 21**.

The by-pass feature of sides 58 and 59 is of importance from another aspect. It will be evident from FIGS. 21 and 22 that if drawer 17 were shifted to its fully open position, the entire narrow portions **58*b* and 59*b* of its slides would remain within cart 1 on guides 38*a* and 39. The slide portions 58*b* and 59*b* cannot lift away from guides 38*a* and 39 because of guides 37*a* and 38 immediately above them. Thus, any of the drawers in cart 1 can be shifted to its fully open position and will nevertheless remain stable and firmly mounted within the cart 1**. In addition, the opening of any drawer in the cart does not expose any other drawer or its contents.

It is common practice to provide a medicine carrying and dispensing cart of the type shown in FIGS. 1 and 2 with a unit generally termed a "cassette". To this end, cassette 18 is illustrated in FIGS. 2, 23 and 24.

The cassette 18 comprises a generally rectangular unit having a top 107, a bottom 108, sides 109 and 110, a rear wall 111 and an open front 112. The cassette is adapted to slidably support a plurality of medicine containing trays, as shown at 113 in FIG. 2.

The cassette 18 is provided with a key actuated locking mechanism 114 by which the trays 113 may be locked in position within the cassette, and by which the cassette may be locked in position in cart 1. The locking mechanism 114 operates a bolt 115 (see FIG. 24) which, when in the locking position, will engage an appropriate one of the lower notches 48 on an appropriate one of the guides of panel 22 or panel 23.

Figure 23:
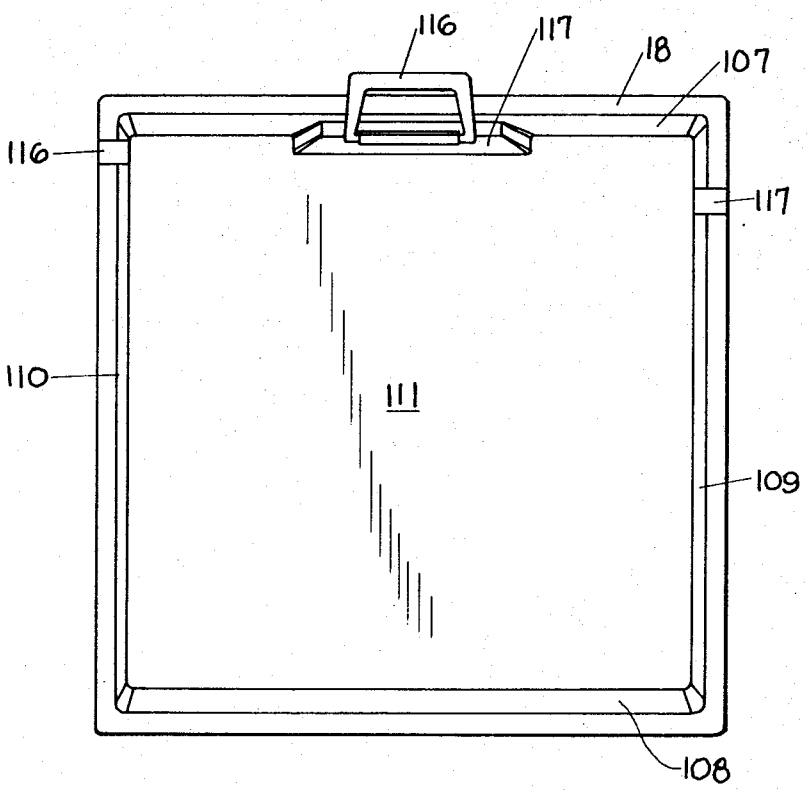
FIG. 23 is a rear elevational view of a cassette for use in the cart of FIGS. 1 and 2.
Figure 24:
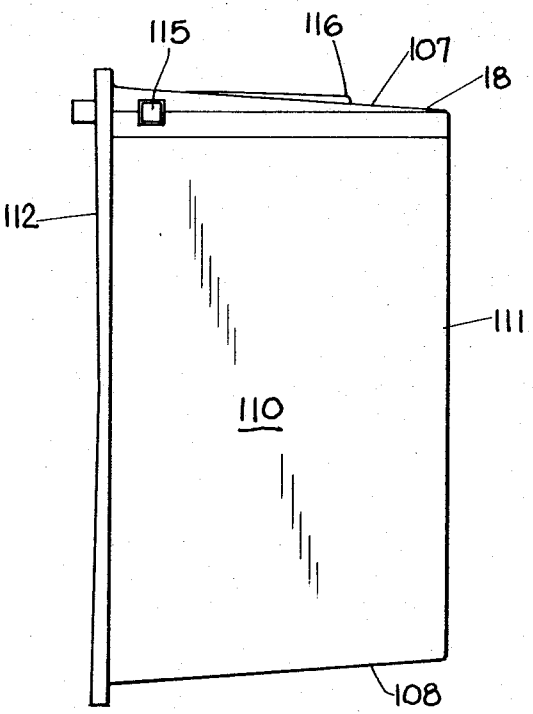
FIG. 24 is a side elevational view of the cassette of FIG. 23.

As is most clearly shown in FIG. 23, the cassette 18 is provided with a first slide 116 and a second slide 117. The slides 116 and 117 are equivalent to slides 58 and 59, respectively, of FIG. 5A. It will be noted that the first slide 116 is vertically offset with respect to the second slide 117. This vertical offset is equivalent to the vertical offset between slides 58 and 59 of FIG. 5A and is equal to the vertical distance between the top surfaces of two adjacent guides (see FIGS. 3 and 4).

Slides 116 and 117 differ in one respect from slides 58 and 59 of FIG. 5A. Slides 116 and 117 do not extend beyond the rear wall 111 of the cassette. There is no need to extend slides 116 and 117 further since the cassette 18 is not intended to be shifted between open and closed positions, as are the drawers. The operation of slides 116 and 117 is identical to that described with respect to slides 58 and 59 of FIGS. 21 and 22. The cassette has a front to rear dimension equivalent to the front to rear dimension of a drawer frame 53. In the exemplary embodiment, the cassette 18 requires the same space as drawers 13 through 16 of FIG. 1. In other words, if the opening 21 in cart has a vertical height of 30 inches, the cassette will take up approximately 21 vertical inches. It will be apparent that the cassette 18 can be inserted from either side of cart 1. It can be so located that the remaining space in the opening 21 is taken up by one or more drawers below it, as in the case of FIG. 2. Similarly, it could be so located that the remaining vertical space of opening 21 is taken up by one or more drawers located above it. Finally, the cassette 18 may be provided with a carrying handle 116 located in a recess 117 in cassette top 107. Thus, when removed from cart 1 the cassette can be easily carried as a separate unit. When it is to be mounted in cart 1, the handle 16 can be folded downwardly into the recess 117 of top 107, as is shown in FIG. 24.

It is preferred that either the panels 22 and 23 or the drawer slides, or both, be molded of a polyethelene plastic material by virtue of its self lubrication characteristics. It will be apparent from the above description that the back-to-back drawer assembly of the present invention is relatively simple and inexpensive to manufacture, does not require any complex moving or telescoping parts, and solves most of the problems encountered with prior art back-to-back systems. It will be evident from the foregoing description that, while the invention is well suited for use in a medical cart or the like, it is equally applicable to any unit having a back-to-back drawer arrangement such as a kitchen cabinet or the like.

Modifications may be made in the invention without departing from the spirit of it.

What we claim is:

1. A drawer assembly for use in a unit having a transverse opening therethrough to accommodate two sets of drawers in back-to-back relationship and openable from opposite sides of the unit, said assembly comprising a plurality of drawer guides and two sets of drawers, said drawer guides being horizontal, rectilinear and arranged in equal numbers at both sides of said opening in parallel, equally spaced relationship, the upper surfaces of corresponding drawer guides at each side of said opening being coplanar, said drawer guides extending substantially the horizontal length of said opening, said sets of drawers being arranged in back-to-back relationship, the total vertical dimension of each set substantially equaling the vertical dimension of said opening, first and second mirror image slides for each of said drawers, said slides being rectilinear and of a length slightly less than the length of said guides, each slide having a bottom surface adapted to cooperate with said upper surfaces of said guides, said first and second slides being affixed to and indentically positioned on each drawer in horizontal, parallel, vertically staggered relationship, the vertical distance between the bottom surfaces of said slides of a drawer being substantially equal to the vertical distance between said upper surfaces of two adjacent guides, the slides of each drawer having portions extending rearwardly of said drawer, all of the slides of the drawers of said sets engaging different guides, each drawer and its slides being shiftable along its respective guides between open and closed positions, the rearwardly extending portions of the slides of each drawer of each set bypassing and extending alongside a drawer of the other set when said drawers are in said closed position.

2. The assembly claimed in claim 1 wherein each slide has a vertically narrow downwardly depending shoulder on its bottom surface near its forward end, each of said guides having a notch formed in its upper surface near each of its ends, the shoulders on the slides of each drawer cooperating with corresponding notches on the guides supporting said slides to maintain said drawer in said closed position unless purposefully opened.

3. The assembly claimed in claim 1 wherein said guides at each side of said opening comprise integral one-piece parts of a molded panel of plastic material.

4. The assembly claimed in claim 1 wherein each drawer of each set comprises an identical, open, rectangular frame, said frame comprising a front panel, a rear panel, and first and second side panels, said panels having upper and lower edges, said first slide being affixed along said first panel near said upper edge thereof, said second slide being affixed along said second side panel near said lower edge thereof, said drawer further comprising a rectangular bottom element having a peripheral upstanding wall thereabout, the free edge of said wall being affixed to said frame panels adjacent said lower edges thereof, the vertical dimension of said bottom element determining, in conjunction with the vertical dimension of said front panel, the overall vertical dimension of said drawer.

5. The assembly claimed in claim 4 wherein each of said frame and said bottom element comprises an integral, one-piece molded plastic structure.

6. The assembly claimed in claim 5 wherein each of said slides comprises an elongated plastic body of channel-shaped cross-section molded about an elongated metallic reinforcing member of correspondingly channel-shaped cross-section, the legs of said channel-shaped body comprising the top and bottom of said slide, the base of said channel-shaped plastic body comprising the outside vertical side of said slide.

7. The assembly claimed in claim 6 wherein each side panel of said drawer frame has a horizontal, laterally extending flange structure extending therealong and comprising an integral, one-piece part thereof, said flange structures being vertically staggered, each slide of said frame receiving said flange structure of its respective side panel within its channel-shaped cross-section and being affixed to said flange structure.

8. A medicine containing cart for use in nursing homes and hospitals, said cart comprising a base frame provided with casters, upstanding end walls and a top, said base frame, said end walls and said top defining a transverse opening in said cart extending from side to side thereof, two sets of drawers in back-to-back relationship being located in said opening and being openable from opposite sides of said cart, equal numbers of horizontal, rectilinear drawer guides being mounted on said cart ends at either side of said opening in parallel, equally spaced relationship, the upper surfaces of corresponding drawer guides at each side of said opening being coplanar, said drawer guides extending substantially the horizontal length of said opening, the total vertical dimension of each of said sets of drawers substantially equaling the total vertical dimension of said opening, first and second mirror image slides for each of said drawers, said slides being rectilinear and of a length slightly less than the length of said guides, each slide having a bottom surface adapted to cooperate with said upper surface of said guides, said first and second slides being affixed to and identically positioned on each drawer in horizontal, parallel, vertically staggered relationship, the vertical distance between the bottom surfaces of said slides of a drawer being substantially equal to the vertical distance between said upper surfaces of two adjacent guides, the slides of each drawer having portions extending rearwardly of said drawer, all of the slides of the drawers of said sets engaging different guides, each drawer and its slides being shiftable along its respective guides between open and closed positions, the rearwardly extending portions of the slides of each drawer of each set bypassing and extending alongside a drawer of the other set when said drawers are in said closed position.

9. The cart claimed in claim 8 wherein each slide has a vertically narrow downwardly depending shoulder on its bottom surface near its forward end, each of said guides having a notch formed in its upper surface near each of its ends, the shoulders on the slides of each drawer cooperating with corresponding notches on the guides supporting said slides to maintain said drawer in said closed position unless purposefully opened.

10. The cart claimed in claim 8 wherein said guides at each side of said opening comprise integal one-piece parts of a molded panel of plastic material affixed to the adjacent upstanding cart end.

11. The cart claimed in claim 8 wherein each drawer of each set comprises an identical, open, rectangular frame, said frame comprising a front panel, a rear panel, and first and second side panels, said panels having upper and lower edges, said first slide being affixed along said first panel near said upper edge thereof, said second slide being affixed along said second side panel near said lower edge thereof, said drawer further comprising a rectangular bottom element having a peripheral upstanding wall thereabout, the free edge of said wall being affixed to said frame panels adjacent said lower edges thereof, the vertical dimension of said bottom element determining, in conjunction with the vertical dimension of said front panel, the overall vertical dimension of said drawer.

12. The cart claimed in claim 8 wherein one of said drawer sets includes a conventional tray-containing cassette, said cassette being provided with horizontal, rectilinear slides affixed to either side thereof in staggered position, each slide having a bottom surface adapted to cooperate with one of said drawer guides, said bottom surfaces of said cassette slides being vertically offset by a distance substantially equal to the vertical distance between the upper surfaces of two adjacent drawer guides.

13. The cart claimed in claim 11 wherein each of said frame and said bottom element comprises an integral, one-piece molded plastic structure.

14. The cart claimed in claim 13 wherein each of said slides comprises an elongated plastic body of channel-shaped cross-section molded about an elongated metallic reinforcing member of correspondingly channel-shaped cross-section, the legs of said channel-shaped body comprising the top and bottom of said slide, the base of said channel-shaped plastic body comprising the outside vertical side of said slide.

15. The cart claimed in claim 14 wherein each side panel of said drawer frame has a horizontal, laterally extending flange structure extending therealong and comprising an integral, one-piece part thereof, said flange structures being vertically staggered, each slide of said frame receving said flange structure of its respective side panel within its channel-shaped cross-section and being affixed to said flange structure.

16. The cart claimed in claim 15 wherein said opening has a vertical dimension of 30 inches, said sets of drawers being made up of drawers selected from drawers having vertical dimensions of 3 inches, 6 inches and 9 inches.

* * * * *